US005374348A

United States Patent [19]

Sears et al.

[11] Patent Number: 5,374,348

[45] Date of Patent: Dec. 20, 1994

[54] HYDROCRACKING OF HEAVY HYDROCARBON OILS WITH HEAVY HYDROCARBON RECYCLE

[75] Inventors: Paul L. Sears, Dunrobin; Theo J. W. de Bruijn, Constance Bay; William H. Dawson, Edmonton; Barry B. Pruden; Anil K. Jain, both of Calgary, all of Canada

[73] Assignee: Energy Mines & Resources - Canada, Ottawa, Canada

[21] Appl. No.: 133,616

[22] Filed: Sep. 13, 1993

[51] Int. Cl.[5] ..... C10G 47/22; C10G 9/12

[52] U.S. Cl. ..... 208/107; 208/48 R; 208/48 AA

[58] Field of Search ..... 208/48 AA, 48 R, 107, 208/108, 212

[56] References Cited

U.S. PATENT DOCUMENTS

| | | | |
|---|---|---|---|
| 3,254,019 | 5/1966 | Mitchell et al. | 208/87 |
| 4,214,977 | 7/1980 | Ranyanathan et al. | 208/48 AA |
| 4,252,634 | 2/1981 | Khulbe et al. | 208/48 |
| 4,396,493 | 8/1983 | Eilers et al. | 208/96 |
| 4,411,768 | 10/1983 | Unger et al. | 208/59 |
| 4,435,280 | 3/1984 | Ranganathan et al. | 208/112 |
| 4,756,819 | 7/1988 | Bousquet et al. | 208/48 |
| 4,770,764 | 9/1988 | Ohtake et al. | 208/73 |
| 4,808,289 | 2/1989 | McDaniel et al. | 208/210 |
| 4,941,966 | 7/1990 | Merz et al. | 208/112 |
| 4,969,988 | 11/1990 | Jain et al. | 208/112 |
| 4,999,328 | 3/1991 | Jain et al. | 502/151 |

*Primary Examiner*—Asok Pal
*Assistant Examiner*—Bekir L. Yildirim

[57] ABSTRACT

A heavy hydrocarbon oil, a substantial portion of which boils above 524° C., is subjected to hydrocracking with a fractionated heavy oil recycle stream containing active additive particles. In the process, a slurry feed of (1) fresh heavy hydrocarbon oil feedstock and a heavy hydrocarbon recycle and (2) from about 0.01–4% by weight (based on fresh feedstock) of iron sulphate additive particles having sizes less than 45 μm, is passed upwardly through a confined vertical hydrocracking zone. A mixed effluent is removed from the top of the hydrocracking zone, which is then passed through a hot separator vessel. From the bottom of the separator is withdrawn a liquid heavy hydrocarbon stream comprising heavy hydrocarbons and particles of the iron sulphate additive converted mainly to an iron sulphide phase. This separated liquid heavy hydrocarbon stream is fractionated to obtain a heavy oil which boils above 450° C., containing the additive particles. The fractionated heavy oil containing the additive particles is then recycled to and mixing with the hydrocracking zone feed slurry in an amount up to 40% by weight of the combined feed slurry.

7 Claims, 1 Drawing Sheet

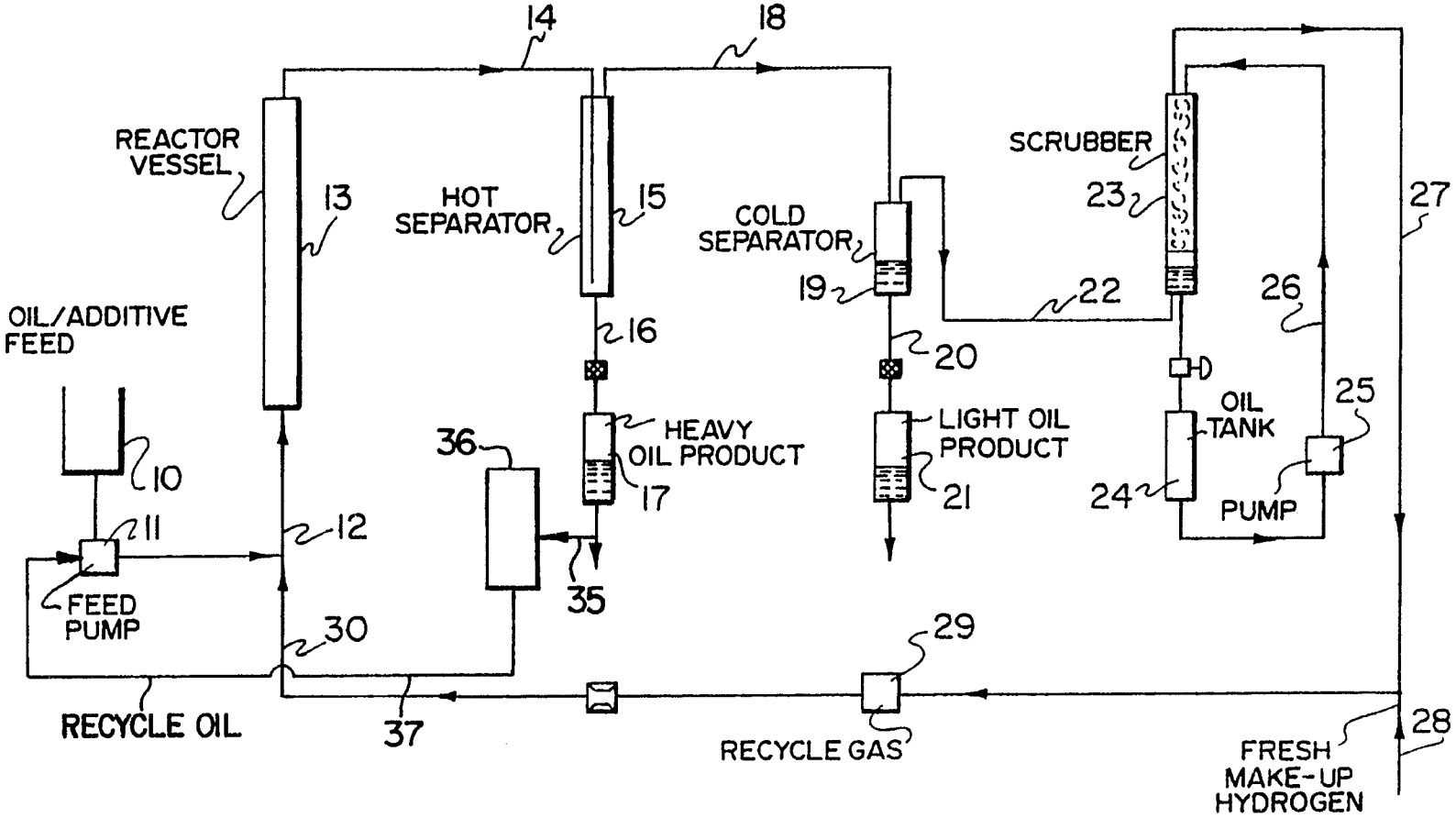
27
28
FRESH MAKE-UP HYDROGEN
25
PUMP
26
OIL TANK
SCRUBBER
23
22
24
LIGHT OIL PRODUCT
20
21
29
RECYCLE GAS
COLD SEPARATOR
19
18
HEAVY OIL PRODUCT
15
16
17
35
14
HOT SEPARATOR
36
37
13
12
30
REACTOR VESSEL
10
11
FEED PUMP
RECYCLE OIL
OIL/ADDITIVE FEED

HYDROCRACKING OF HEAVY HYDROCARBON OILS WITH HEAVY HYDROCARBON RECYCLE

BACKGROUND OF THE INVENTION

This invention relates to the treatment of hydrocarbon oils and, more particularly, to the hydrocracking of heavy hydrocarbon oils to produce improved products of lower boiling range.

Hydrocracking processes for the conversion of heavy hydrocarbon oils to light and intermediate naphthas of good quality for reforming feed stocks, fuel oil and gas oil are well known. These heavy hydrocarbon oils can be such materials as petroleum crude oil, atmospheric tar bottoms products, vacuum tar bottom products, heavy cycle oils, shale oils, coal-derived liquids, crude oil residuum, topped crude oils and heavy bituminous oils extracted from tar sands. Of particular interest are oils extracted from tar sands and which contain wide boiling range materials from naphthas through kerosene, gas oil, pitch, etc. and which contain a large portion of material boiling above 524° C. These heavy hydrocarbon oils contain nitrogen and sulphur compounds in extremely large quantities and often contain excessive quantities of organo-metallic contaminants which tend to be detrimental to various catalytic processes which may subsequently be carried out, such as hydrofining. Of the metallic contaminants, those containing nickel and vanadium are most common, although other metals are often present. These metallic contaminants, as well as others, are usually present within the bituminous material as organo-metallic compounds of relatively high molecular weight. A considerable quantity of the organo-metallic complexes are linked with asphaltenic material and contain sulphur.

As the reserves of conventional crude oils decline, the heavy oils must be upgraded to meet the demands. In this upgrading, the heavier material is converted to lighter fractions and most of the sulphur, nitrogen and metals must be removed. This is usually done by means of a hydrocracking process.

In catalytic hydrocracking, the mineral matter present in the feed stock tends to deposit on the surface of the expensive catalyst, making it extremely difficult to regenerate, again resulting in increased production cost. The non-catalytic or thermal hydrocracking process can give a distillate yield of over 85 weight percent but in this process, there is a very considerable problem of the formation of coke deposits on the wall of the reactor which ultimately plug the reactor and cause costly shutdowns.

It is known to recycle downstream heavy hydrocarbon products in thermal hydrocracking processes for the purpose of improving efficiency. For instance, Wolk, U.S. Pat. No. 3,844,937, issued Oct. 29, 1974 describes a process for utilizing a high ash content in the hydrocracking zone fluid e.g. in the range of 4–10 weight percent as a means for preventing the formation of coke in the hydrocracking zone. In order to achieve this ash content in the fluid, a recycle of heavy hydrocarbons from a hot separator was used and as a part of this recycle, the heavy hydrocarbons from the hot separator were passed through a cyclone or through another low pressure separator. This was carried out at quite low recycle rates and, consequently, quite low liquid up-flow velocities in the hydrocracking zone.

Another prior system utilizing recycle of separator bottoms is Schlinger et al. U.S. Pat. No. 3,224,959, issued Dec. 21, 1965. In that procedure, the heavy hydrocarbons from the hot separator were contacted with a separate hydrogen stream heated to a temperature between 800° and 950° F. and this hydrogen treated product was then recycled into the hydrocracking zone. This procedure involved extremely high hydrogen recirculation rates of up to 95,000 s.c.f/b.b.l. making the procedure very expensive. Moreover, the reaction zone was operated at a high turbulence which resulted in reduced pitch conversion with high operating and production costs.

In Ranganathan et al, U.S. Pat. No. 4,435,280, issued Mar. 6, 1984, a process is described in which a feed slurry of heavy hydrocarbon oil and coal particles was passed upwardly through a vertical hydrocracking zone while a drag stream of liquid content of the hydrocracking zone was drawn off. A portion of this drag stream could be recycled to the feed slurry. However, there are no examples showing that the recycle was ever used and it cannot be seen that there would be any particular benefit in doing so. Thus, the recycle would only remove liquid from the hydrocracking and feed it back in where it came from.

Another patent which describes recycle is Khulbe et al, U.S. Pat. No. 4,252,634. This describes a process for hydrocracking heavy hydrocarbon oils with recycle of heavy oil from a downstream hot separator. The purpose of this recycle was to increase the superficial liquid upflow velocity in the hydrocracking zone to at least 0.25 cm/sec such that deposition of coke in the hydrocracking zone was substantially eliminated. Mixed effluent from the top of the hydrocracking zone was also discharged into the hot separator vessel in a lower region below the liquid level to provide vigorous mixing action in the bottom of the separator, thereby also substantially preventing coke deposits in the hot separator.

In Unger et al, U.S. Pat. No. 4,411,768, issued Oct. 25, 1984 a recycle is used in a catalytic hydrogenation operation with a fractionated heavy product stream being recycle to a hydrogenation stage. This process is carried out in an ebullated catalytic bed and there is no catalyst in the recycle.

It is an object of the present invention to provide a process for hydrocracking heavy hydrocarbon oils in which additive particles are included in the feedstock to suppress coke formation and downstream fractionated heavy product is recycled to the feedstock with active additive particles being retained in the recycle.

SUMMARY OF THE INVENTION

In accordance with the present invention, there is described a process for hydrocracking a heavy hydrocarbon oil feedstock, a substantial portion of which boils above 524° C. which comprises: (a) passing a slurry feed of (1) a mixture of fresh heavy hydrocarbon oil feedstock and a heavy hydrocarbon recycle and (2) from about 0.01–4.0% by weight (based on fresh feedstock) of iron sulphate additive particles having sizes less than 45 μm, upwardly through a confined vertical hydrocracking zone, said hydrocracking zone being maintained at a temperature between about 350° and 600° C., a pressure of at least 3.5 MPa and a space velocity of up to 4 volumes of hydrocarbon oil per hour per volume of hydrocracking zone capacity, (b) removing from the top of said hydrocracking zone a mixed effluent containing a gaseous phase comprising hydrogen and vaporous hydrocarbons and a liquid phase comprising heavy hydrocarbons, (c) passing said mixed effluent into a hot separator vessel, (d) withdrawing from the top of the separator a gaseous stream comprising hydrogen and vaporous hydrocarbons, (e) withdrawing from the bottom of the separator a liquid stream comprising heavy hydrocarbons and particles of the iron sulphate additive converted mainly to an iron sulphide phase, (f) fractionating the separated liquid stream to obtain a heavy hydrocarbon stream which boils above 450° C., said heavy hydrocarbon stream containing said additive particles, and (g) recycling said fractionated heavy hydrocarbon stream containing said additive particles as the recycle portion of the feed slurry in an amount of up to 40% by weight of the combined feed slurry.

It has surprisingly been found according to the present invention that the additive particles are able to survive the hydrocracking process and remain effective as part of the recycle. This is not true of prior art hydrocracking processes with heavy oil recycle and the usual situation is that the additive particles become coked and contaminated with metals, and must be replaced or regenerated. It is believed that the reasons for the additive surviving the process to remain active in the recycle stream is because of the additive being used (iron sulphate), its small particle size and the fact that the iron sulphate converts mainly to an iron sulphide phase during the reaction. The particulate additive that is used in the present invention is typically the one described in Belinko et al, U.S. Pat. No. 4,963,247, issued Oct. 16, 1990. Thus, the particles are typically ferrous sulphate having particle sizes less than 45 μm and with a major portion, i.e. at least 50% by weight, preferably having particle sizes of less than 10 μm. It is particularly advantageous to have a substantial portion of the particles of less than 5 μm.

Because the recycle stream contains active additive, it is able to serve as part of the additive in the feedstock slurry. For instance, the recycle system of the invention is capable of decreasing the fresh additive requirement by as much as 40% or more. Preferably the additive particles are used in an amount of less than 3% by weight of the fresh feedstock.

The process of this invention is particularly well suited for the treatment of heavy hydrocarbon oils having at least 10%, preferably at least 50%, by weight of which boils above 524° C. and which may contain a wide boiling range of materials from naphtha through kerosene, gas oil and pitch. It can be operated at quite moderate pressure, preferably in the range of 3.5 to 24 MPa, without coke formation in the hydrocracking zone. The reactor temperature is typically in the range of 350° to 600° C., with a temperature of 400° to 500° C. being preferred. The LHSV is typically below 4 $h^{-1}$ on a fresh feed basis, with a range of 0.1 to 3 $h^{-1}$ being preferred and a range of 0.3 to 1 $h^{-1}$ being particularly preferred.

Although the hydrocracking can be carried out in a variety of known reactors of either up or downflow, it is particularly well suited to a tubular reactor through which feed and gas move upwardly. The effluent from the top is preferably separated in a hot separator and the gaseous stream from the hot separator can be fed to a low temperature, high pressure separator where it is separated into a gaseous stream containing hydrogen and less amounts of gaseous hydrocarbons and liquid product stream containing light oil product.

According to a preferred embodiment, the particles of iron sulphate are mixed With a heavy hydrocarbon oil feed and pumped along with hydrogen through a vertical reactor. The liquid-gas mixture from the top of the hydrocracking zone can be separated in a number of different ways. One possibility is to separate the liquid-gas mixture in a hot separator kept at a temperature in the range of about 200°–470° C. and at the pressure of the hydrocracking reaction. A portion of the heavy hydrocarbon oil product from the hot separator is used to form the recycle stream of the present invention after secondary treatment. Thus, the portion of the heavy hydrocarbon oil product from the hot separator being used for recycle is fractionated in a distillation column with a heavy liquid stream being obtained which boils above 450° C. This heavy oil stream preferably boils above 495° C., with a heavy oil boiling above 524° C. being particularly preferred. This heavy oil stream is then recycled back to form part of the feed slurry to the hydrocracking zone. The surprising feature of this invention is that the fractionated heavy oil stream being recycled to the feed slurry contains coke suppressing additive particles in still active form. Preferably, this recycled heavy oil stream makes up in the range of about 10 to 30% of the slurry feed to the hydrocracking zone.

The gaseous stream from the hot separator containing a mixture of hydrocarbon gases and hydrogen is further cooled and separated in a low temperature-high pressure separator. By using this type of separator, the outlet gaseous stream obtained contains mostly hydrogen with some impurities such as hydrogen sulphide and light hydrocarbon gases. This gaseous stream is passed through a scrubber and the scrubbed hydrogen may be recycled as part of the hydrogen feed to the hydrocracking process. The hydrogen gas purity is maintained by adjusting scrubbing conditions and by adding make up hydrogen.

The liquid stream from the low temperature-high pressure separator represents a light hydrocarbon oil product of the present invention and can be sent for secondary treatment.

BRIEF DESCRIPTION OF THE DRAWING

For a better understanding of the invention, reference is made to the accompanying drawing which illustrates diagrammatically a preferred embodiment of the present invention.

It is a schematic flow sheet showing a typical hydrocracking process to which the present invention may be applied.

DESCRIPTION OF THE PREFERRED EMBODIMENTS

In the hydrocracking process as shown in the drawing, the iron salt additive is mixed together with a heavy hydrocarbon oil feed in a feed tank 10 to form a slurry. This slurry, including heavy oil recycle 37, is pumped via feed pump 11 through an inlet line 12 into the bottom of an empty tower 13. Recycled hydrogen and make up hydrogen from line 30 are simultaneously fed into the tower through line 12. A gas-liquid mixture is withdrawn from the top of the tower through line 14 and introduced into a hot separator 15. In the hot separator the effluent from tower 13 is separated into a gaseous stream 18 and a liquid stream 16. The liquid stream 16 is in the form of heavy oil which is collected at 17.

The gaseous stream from hot separator 15 is carried by way of line 18 into a high pressure-low temperature separator 19. Within this separator the product is separated into a gaseous stream rich in hydrogen which is drawn off through line 22 and an oil product which is drawn off through line 20 and collected at 21.

The hydrogen-rich stream 22 is passed through a packed scrubbing tower 23 where it is scrubbed by means of a scrubbing liquid 24 which is recycled through the tower by means of a pump 25 and recycle loop 26. The scrubbed hydrogen-rich stream emerges from the scrubber via line 27 and is combined with fresh makeup hydrogen added through line 28 and recycled through recycle gas pump 29 and line 30 back to tower 13.

The heavy oil collected at 17 is used to provide the heavy oil recycle of the invention and before being recycled back into the slurry feed, a portion is drawn off via line 35 and is fed into fractioner 36 with a heavy oil stream boiling above 450° C., preferably above 524° C. being drawn off via line 37. This line connects to feed pump 11 to comprise part of the slurry feed to reactor vessel 13.

DESCRIPTION OF THE PREFERRED EMBODIMENTS

Certain preferred embodiments of this invention are illustrated in the following non-limiting examples.

EXAMPLE 1

The feedstock used was a cold Lake vacuum tower bottoms boiling above 446° C. The feedstock had the following properties:

TABLE 1

| Properties of the Feedstock | |
|---|---|
| %C, wt % | 83.24 |
| %H, wt % | 10.19 |
| %S, wt % | 5.58 |
| %N, wt % | 0.56 |
| Sum, wt % | 99.57 |
| °API | 5.1 |
| CCR, wt % | 21.1 |
| Distillation, | |
| 204–343° C., wt % | 0.6 |
| 343–524° C., wt % | 24.1 |
| 524° C.+, wt % | 75.3 |
| % PI, wt % | |
| % TI, wt % | |
| % Ash, wt % | 0.07 |
| Fe, ppm | 7.4 |
| Ni, ppm | 74.2 |
| V, ppm | 217.4 |

PI = Pentane insolubles
TI = Toluene insolubles
CCR = Conradson Carbon Residue

The additive which was used was ferrous sulphate monohydrate which had been dry ground using an ACM 10 pulverizer. A micron separator was used after the pulverizer to produce a fine grind additive. A typical assay of the additive is shown in Table 2 below:

TABLE 2

| | wt % |
|---|---|
| Iron | 29.000–31.000 (Average 30%) |
| Sulphate | 56.5000 |
| Water | 12.000 |
| Magnesium | 1.2100 |
| Manganese | 0.0300 |
| Titanium | 0.1400 |
| Arsenic | <0.0001 |
| Lead | <0.0001 |
| Cadmium | <0.0001 |

TABLE 2-continued

| | wt % |
|---|---|
| Mercury | <0.0001 |
| Chromium | 0.0003 |
| Selenium | 0.0010 |
| Silver | 0.0002 |
| Antimony | 0.0030 |
| Zinc | 0.0050 |
| Calcium | 0.0080 |

The additive particle distribution, as obtained with a Hiac 720 instrument was as shown in Table 3 below:

TABLE 3

| Particle size (μm) | Cumulative % below |
|---|---|
| 3 | 4.6 |
| 5 | 24.5 |
| 10 | 65.2 |
| 20 | 94.2 |
| 46 | 96.9 |
| 126 | 100.0 |

The above ferrous sulphate monohydrate contained approximately 25% of particles having sizes less than 5 μm and approximately 65% of particles having sizes less than 10 μm. About 95% of the particles had sizes less than about 20 μm.

The above feedstock and particulate were used for carrying out a series of hydrocracking tests with recycle utilizing a hydrocracking pilot plant having a capacity of 50 L per day.

The pilot plant hydrocracker was heated to 350° C. and the feed was introduced at this temperature and thereafter the temperature was gradually increased to an operating temperature of 447° C. The pilot plant was operated on a continuous basis at temperatures between 447° and 453° C., LHSV of 0.4 to 0.7 $h^{-1}$, a pressure of 13.8 MPa and a gas rate of 28 L/min.

(A) Base line runs

A series of base line runs without recycle were first carried out to obtain the processing characteristics of the feedstock, the pitch conversion of different conditions and the amount of additive needed for incipient coking temperature operation.

Each test was run for from 1 to 10 days and the results obtained are summarized in Table 4 below:

TABLE 4

| Temperature °C. | HLSV $h^{-1}$ | % Conversion | ICT Additive, wt % |
|---|---|---|---|
| 447 | 0.66 | 80.6 | 1.8 |
| 447 | 0.55 | 86.9 | 1.9 |
| 447 | 0.42 | 91.4 | 2.0 |
| 447 | 0.36 | 94.5 | 2.0 |
| 450 | 0.70 | 85.0 | 2.0 |
| 453 | 0.65 | 89.3 | 2.0 |

(B) Recycle Runs

Using the feedstock and additives described above, a series of three tests were carried out with recycle. The pilot plant was operated at a pressure of 13.8 MPa and a hydrogen gas rate of 28 l/min at a gas purity of 85%.

The recycle heavy oil was prepared by fractionating hot separator heavy bottoms to cut points between 450° C. and 495° C. The ratio of fresh feed/recycle heavy oil was varied between 80/20 and 89/11, the reactor temperature was varied between 447° and 453° C. and the LHSV was varied between 0.45 and 0.68 $h^{-1}$.

A summary of the recycle conditions is shown in Table 5 below:

TABLE 5

| Recycle Run # | Fresh Feed/ Recycle Heavy Oil Ratio | Recycle Cut Point °C. | Reactor Temperature °C. | Fresh Feed Space Velocity $h^{-1}$ |
|---|---|---|---|---|
| 1 | 86/14 | 450 | 447 | 0.68 |
| 2 | 86/14 | 495 | 447 | 0.65 |
| 3 | 86/14 | 495 | 447 | 0.45 |

The results obtained from the above recycle runs are shown in Table 6 below:

TABLE 6

| Recycle Run # | Conversion at Equilibrium (%) | Additive Conc. in Fresh Feed (%) | Additive Conc. in Recycled Material (%) | Additive Conc. in Material Entering Reactor (%) |
|---|---|---|---|---|
| 1 | 78.3 | 1.2 | 4.2 | 1.6 |
| 2 | 79.4 | 1.0 | 5.5 | 1.6 |
| 3 | 86.7 | 1.0 | 3.3 | 1.3 |

The above results show a 30–50% reduction in the requirement of fresh additive particles because of the active particles present in the recycle.

We claim:

1. A process for hydrocracking a heavy hydrocarbon oil feedstock, a substantial portion of which boils above 524° C., which comprises:

(a) passing a slurry feed of (1) fresh heavy hydrocarbon oil feedstock and a heavy hydrocarbon recycle and (2) from about 0.01–4% by weight (based on fresh feedstock) of iron sulphate additive particles having sizes less than 45 μm with at least 50% by weight of the particles having sizes less than 10 μm, upwardly through a confined vertical hydrocracking zone, said hydrocracking zone being maintained at a temperature between about 350° and 600° C., a pressure of at least 3.5 MPa and a space velocity of up to 4 volumes of fresh .hydrocarbon oil per hour per volume of hydrocracking zone capacity, (b) removing from the top of said hydrocracking zone a mixed effluent containing a gaseous phase comprising hydrogen and vaporous hydrocarbons and a liquid phase comprising heavy hydrocarbons, (c) passing said mixed effluent into a hot separator vessel, (d) withdrawing from the top of the separator a gaseous stream comprising hydrogen and vaporous hydrocarbons, (e) withdrawing from the bottom of the separator a liquid heavy hydrocarbon stream comprising heavy hydrocarbons and particles of the iron sulphate additive converted mainly to an iron sulphide phase, (f) fractionating the separated liquid heavy hydrocarbon stream to obtain a heavy oil which boils above 450° C., said heavy oil containing said additive particles, and (g) recycling said fractionated heavy oil containing said additive particles to and mixing with the hydrocracking zone feed slurry in an amount up to 40% by weight of the combined feed slurry.

2. A process according to claim 1 wherein up to 25% by weight of said iron sulphate particles have sizes less than 5 μm.

3. A process according to claim 1 wherein the feed slurry contains 0.01 to 3.0% by weight (based on fresh feedstock) of said iron sulphate particles.

4. A process according to claim 1 wherein the recycled heavy oil comprises about 10 to 30% by weight of the feed slurry.

5. A process according to claim 1 wherein the recycled heavy oil has a boiling point above 495° C.

6. A process according to claim 1 wherein the recycled heavy oil has a boiling point of 524° C.

7. A process according to claim 1 wherein the LHSV is in the range of 0.1 to 3 $h^{-1}$ on a fresh feed basis.

* * * * *